US007547192B2

(12) United States Patent
Caruso et al.

(10) Patent No.: US 7,547,192 B2
(45) Date of Patent: Jun. 16, 2009

(54) TORQUE-TUNED, INTEGRALLY-COVERED BUCKET AND RELATED METHOD

(75) Inventors: David Alan Caruso, Ballston Lake, NY (US); Joseph Mark Serafini, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 632 days.

(21) Appl. No.: 11/065,039

(22) Filed: Feb. 25, 2005

(65) Prior Publication Data

US 2006/0193726 A1 Aug. 31, 2006

(51) Int. Cl.
*F01D 5/30* (2006.01)

(52) U.S. Cl. ..... 416/190; 416/248

(58) Field of Classification Search ..... 416/190, 416/248, 191, 222, 193 A, 196 R, 195, 2, 416/204 A, 239, 212 A, 240
See application file for complete search history.

(56) References Cited

U.S. PATENT DOCUMENTS

| | | | | |
|---|---|---|---|---|
| 2,315,610 | A * | 4/1943 | Flanders | 416/190 |
| 4,497,613 | A | 2/1985 | Carreno | |
| 5,509,784 | A | 4/1996 | Caruso et al. | |
| 6,158,104 | A | 12/2000 | Roberts et al. | |
| 2004/0165989 | A1 | 8/2004 | Caruso et al. | |
| 2006/0127221 | A1 * | 6/2006 | Yamashita et al. | 416/222 |

* cited by examiner

*Primary Examiner*—Richard Edgar
(74) *Attorney, Agent, or Firm*—Nixon & Vanderhye, P.C.

(57) ABSTRACT

A turbine bucket includes a shank portion, an adjacent and radially inner dovetail mounting portion, an adjacent and radial outer airfoil portion, with a platform at a radially inner end of said airfoil portion adjacent the shank portion, and an integral cover at a radially outer tip of the airfoil portion, wherein the shank portion is shaped to provide a torque zone establishing a desired torque characteristic for the bucket to create, upon insertion into a dovetail groove on a turbine wheel, a desired contact pressure between the integral cover and adjacent covers in a row of similar buckets.

11 Claims, 2 Drawing Sheets

TORQUE-TUNED, INTEGRALLY-COVERED BUCKET AND RELATED METHOD

This invention relates generally to steam turbine technology, and specifically, to an integrally covered bucket blade with a torque zone in the solid shank area radially between the dovetail mounting portion and the airfoil portion of the bucket.

BACKGROUND OF THE INVENTION

Turbine blades, often referred to as buckets, are subject to vibrational stresses that can impact engine efficiency and part life. To reduce these stresses, a number of ways of damping or limiting bucket vibrations have been devised. One approach is to frictionally dampen certain modes of vibrations by interlocking the tips of covered or tip-shrouded buckets. To dampen vibratory stimuli and control natural frequencies, the integral covers or shrouds of the buckets must maintain contact from bucket to bucket within an annular row. To create the requisite interlock, the airfoil or blade portions are twisted during assembly. This pre-twist is in a circumferential direction as viewed along the long axis of the respective bucket. During operation, centrifugal forces will cause radial growth and twisting of the bucket blade portions, tending to open circumferential gaps between the blade tip covers. Thus, the covers must be assembled with enough compressive contact force between the respective adjacent buckets to provide residual force during operation despite the effects of centrifugal forces. The greater the interference required, the greater the required angle of rotation.

In other words, the present method of assembling integrally covered buckets is to twist the airfoil portion of each bucket so that the pitch of the tip cover (or simply, "cover") decreases, allowing an entire row of buckets to be placed on the rotor. The inherent torque of the airfoil portion then causes the cover to untwist which produces a residual interference that keeps the row of buckets coupled during operation.

The torque characteristics of the airfoil portion of the bucket may preclude the use of an integral tip cover, however, if the torque characteristics of the airfoil portion do not provide for the desired coupling face pressure at the integral bucket tip covers.

BRIEF DESCRIPTION OF THE INVENTION

The present invention seeks to disassociate the torque characteristics of the airfoil portion of the bucket from the determination of sufficient bucket cover coupling. In the exemplary embodiment, this is achieved by designing the shank area of the bucket with a specific cross-sectional shape that will achieve a desired torque characteristic for the bucket as a whole in order to obtain the desired contact pressure at the cover coupling facings. In other words, the degree of pre-twist needed to achieve the desired tip cover interference is applied in a torque zone spaced from the airfoil portion rather than in the airfoil portion proper. Various suitable geometrical cross sections that may be utilized to achieve the desired end result can be obtained by machining material away from the solid shank area above the dovetail mounting portion of the bucket.

For example, the torque zone may take the form of a reduced cross-sectional area of circular shape. Other cross-sectional shapes disclosed herein include substantially N-shaped; H-shaped; elongated rectangle-shaped arranged parallel to, at an angle to, or perpendicular to the fore and aft bucket platform edges; and other more complex shapes described further herein. The invention is not limited, however, to the specific shapes disclosed, but also includes other reduced cross-sectional configurations that create a torque zone that allows the desired pre-twist for tip cover coupling to be applied in the torque zone, without having to separately pre-twist the airfoil portion of the bucket.

Accordingly, in one aspect, the present invention relates to a turbine bucket comprising a shank portion, an adjacent and radially inner dovetail mounting portion, an adjacent and radial outer airfoil portion, with a platform at a radially inner end of said airfoil portion adjacent the shank portion, and an integral cover at a radially outer tip of the airfoil portion, wherein the shank portion is shaped to provide a torque zone establishing a desired torque characteristic for the bucket to create, upon insertion into a dovetail groove on a turbine wheel, a desired contact pressure between the integral cover and adjacent covers in a row of similar buckets.

In another aspect, the present invention relates to method of disassociating torque characteristics of an airfoil portion of a turbine bucket from contact pressure at coupling faces of adjacent integral bucket tip covers comprising (a) determining a desired degree of contact pressure at coupling faces of tip covers of adjacent buckets; (b) forming a reduced cross-sectional area torque zone in a solid shank portion of each bucket, located radially between a bucket dovetail mounting portion and a bucket platform adjacent the airfoil portion; and (c) during assembly of a plurality of the turbine buckets on a rotor wheel, applying torque only in the torque zone to achieve the desired contact pressure at the coupling faces of the tip covers.

The invention will now be described in connection with the drawings identified below.

DETAILED DESCRIPTION OF THE INVENTION

Figure 1:
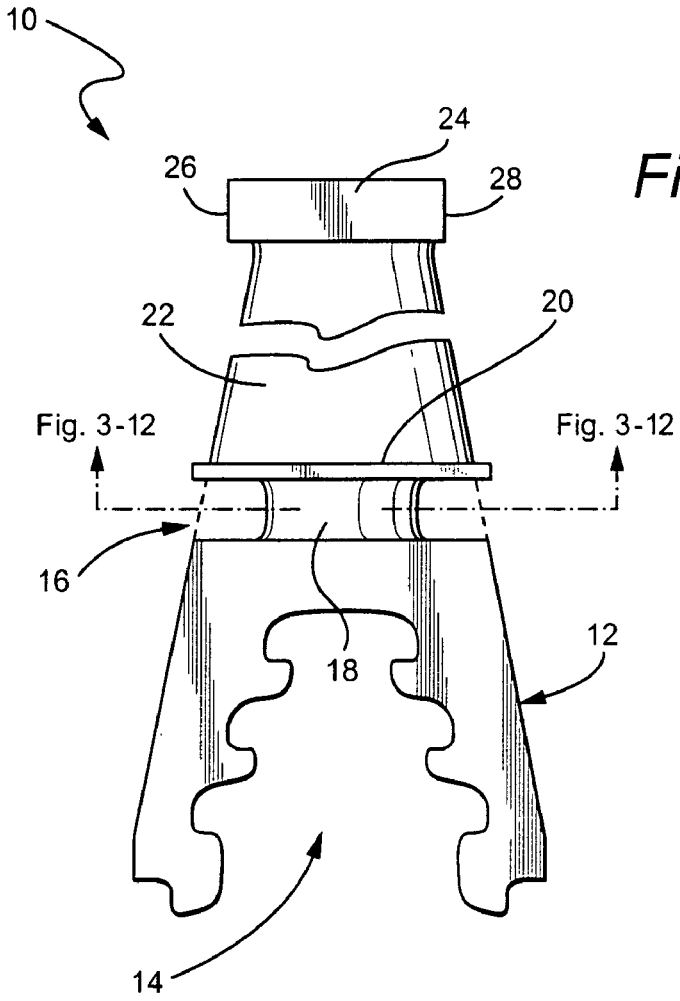
FIG. 1 illustrates a front elevation of a steam turbine bucket in accordance with an exemplary embodiment of the invention.
Figure 2:
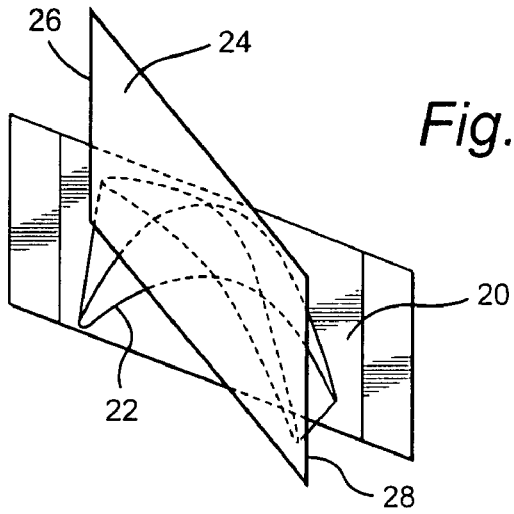
FIG. 2 is a top plan view of the bucket shown in FIG. 1.
Figure 3:
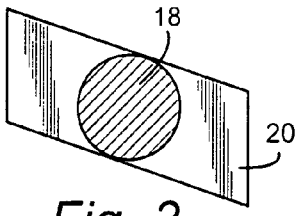
FIG. 3 is a simplified cross section taken through the line 3-3 of FIG. 1.

With reference initially to FIG. 1, a steam turbine bucket 10 in accordance with an exemplary embodiment of the invention is formed with a lower dovetail mounting portion 12 including a conventional dovetail slot or groove 14. Adjacent the dovetail mounting portion 12 (in a radially outward direction) is a solid shank portion 16 which has been machined in accordance with the invention to provide a torque zone 18 located radially between the dovetail portion 12 and the bucket platform 20. Extending radially away from the bucket platform is the airfoil portion 22 that is formed with an integral tip cover 24. In this first embodiment, the shank portion 16 has been machined to produce a torque zone 18 that has a reduced, circular cross-sectional shape as seen in FIG. 3. The amount of material machined away from the shank portion is determined by the desired torque characteristics for the bucket 10. The torque characteristics, in turn, are chosen in order to obtain the desired contact pressure at the coupling faces, i.e., where surfaces 26, 28 (FIG. 2) of the integral cover 24 engages similar cover surfaces of adjacent buckets.

It will be appreciated that various other geometrical cross sections may be applied to the torque zone. For example, FIG.

4 illustrates a torque zone 30, located radially between a dovetail portion and platform, that is substantially N-shaped in cross section. More specifically, the modified shank portion includes sides 32, 34 that are parallel to the end edges of the platform 36 and a diagonal web 38 therebetween.

Figure 5:
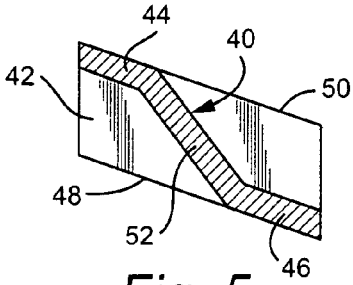

In FIG. 5, the torque zone 40, located radially between the dovetail mounting portion and the platform 42, includes portion 44, 46 on pressure and suction sides 48, 50 of the platform 42 connected by a diagonal portion or web 52.

Figure 6:
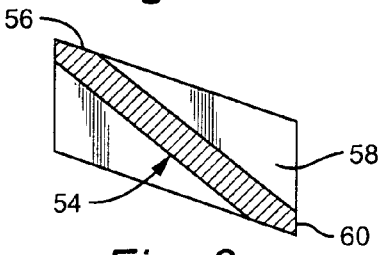

In FIG. 6, the shank portion 16 has been machined to produce a torque zone 54 of substantially rectangular shape in cross section, extending diagonally from one corner 56 of the platform 58 to an opposite corner 60 thereof.

Figure 7:
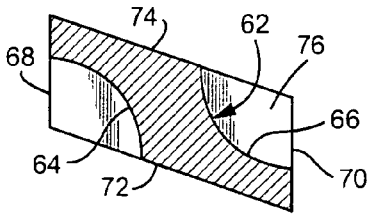

In FIG. 7, a generally diagonally-oriented torque zone 62 is defined by oppositely-facing curved surfaces 64, 66, each of which extend between ends 68, 70 and adjacent sides 72, 74, respectively, of the platform 76.

Figure 8:
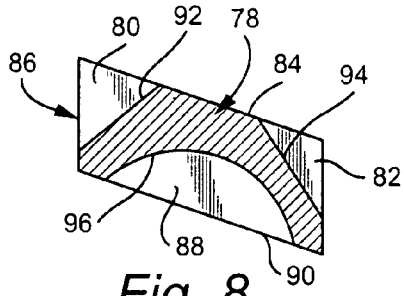
FIGS. 4-12 represent alternative cross-sectional shapes as viewed from a section line located in the same plane as section line 3-3 of FIG. 1.
Figure 4:
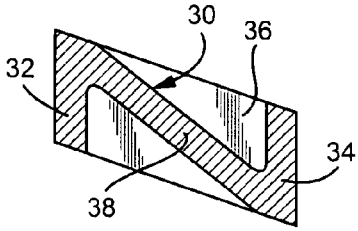

In FIG. 8, a torque zone 78 is formed by machining material away from two corner areas 80, 82 on the suction side 84 of the shank portion, below platform 86, and a radiused middle portion 88 from the opposite pressure side 90 of the shank portion. More specifically, the torque zone 78 is defined by diagonal edges 92, 94 that define the corner areas 80, 82, and a curved edge 96 that intersects platform side edge 90 at both ends thereof.

Figure 9:
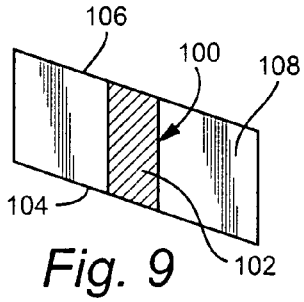

In FIG. 9, the torque zone 100 is formed as a generally rectangular web 102 extending substantially perpendicular to opposite suction side edge 104 and pressure side edge 106 of the platform 108.

Figure 10:
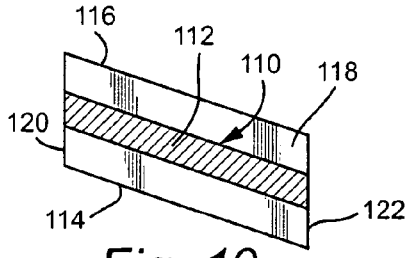

In FIG. 10, the torque zone 110 is formed by a generally rectangular web 112 extending substantially parallel to pressure and suction side edges 114, 116, respectively, of the platform 118, between opposite ends 120, 122.

Figure 11:
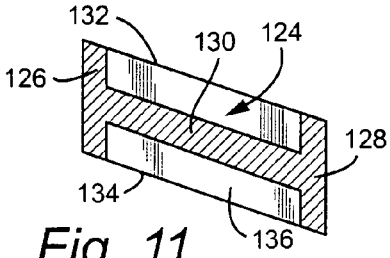

FIG. 11 shows a torque zone 124 that is substantially H-shaped in cross section, including end regions 126, 128 connected by a middle cross-web 130 extending parallel to pressure and suction side edges 132, 134 of the platform 136.

Figure 12:
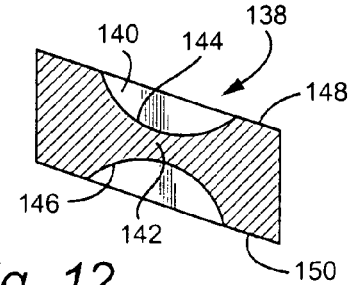

In FIG. 12, the torque zone 138 has a cross section similar to a corresponding cross section of the adjacent platform 140 but with a narrow neck area 142 defined by opposed arcuate surfaces 144, 146 machined away from the torque zone, and opening towards respective suction and pressure side edges 148, 150 of the platform 140.

As indicated above, other cross-sectional shapes for the torque zone in the bucket shank portion are also contemplated by the invention, so long as the torque characteristics of the bucket as a whole provide the desired coupling of adjacent integral tip covers without having to apply torque to the respective airfoil portions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of disassociating torque characteristics of an airfoil portion of a turbine bucket from contact pressure at coupling faces of adjacent integral bucket tip covers comprising:

(a) forming a reduced cross-sectional area torque zone in a solid shank portion of each bucket, located radially between a bucket dovetail mounting portion and a bucket platform adjacent the airfoil portion wherein said torque zone has a cross-sectional area smaller than said platform and said dovetail mounting portion on opposite sides of said torque zone; and (b) during assembly of a plurality of said turbine buckets on a rotor wheel, applying torque only in said torque zone to achieve a predetermined contact pressure at the coupling faces of the tip covers.

2. The method of claim 1 wherein said torque zone is circular in cross section.

3. The method of claim 1 wherein said torque zone is substantially H-shaped in cross section.

4. The method of claim 1 wherein said torque zone is rectangular in cross section, extending substantially parallel to opposite suction and pressure sides of said platform.

5. The method of claim 1 wherein said torque zone is rectangular in cross section, extending substantially perpendicular to opposite suction and pressure sides of said platform.

6. The method of claim 1 wherein said torque zone is substantially rectangular in cross section, extending diagonally from one side of said platform to an opposite side thereof.

7. The method of claim 1 wherein said torque zone has a cross section similar to a corresponding cross section of said platform but with a pair of opposed arcuate sections machined away from said torque zone along opposite suction and pressure sides thereof.

8. The method of claim 1 wherein, in cross section, said torque zone includes first and second portions at opposite ends of said platform connected by a diagonal web.

9. The method of claim 8 wherein said diagonal web is defined by a pair of oppositely facing curved surfaces.

10. The method of claim 1 wherein said torque zone is formed by machining material away from two corners on one side of the shank and a middle portion from an opposite side of said shank.

11. The method of claim 1 wherein said torque zone is substantially N-shaped in cross section.

* * * * *